US008261402B2

(12) United States Patent
Rosenzweig et al.

(10) Patent No.: US 8,261,402 B2
(45) **Date of Patent: *Sep. 11, 2012**

(54) FABRIC PAD FOR A STEAM MOP

(75) Inventors: Maximilian Rosenzweig, Montreal (CA); Aviva Rosenzweig, legal representative, Montreal (CA); Ognjen Vrdoljak, Laval (CA)

(73) Assignee: Euro-Pro Operating LLC, Newton, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/044,301

(22) Filed: Mar. 7, 2008

(65) Prior Publication Data

US 2009/0000051 A1 Jan. 1, 2009

Related U.S. Application Data

(63) Continuation-in-part of application No. 11/769,521, filed on Jun. 27, 2007, now Pat. No. 8,205,293.

(51) Int. Cl.

| | |
|---|---|
| ***A47L 25/00*** | (2006.01) |
| ***A47L 13/10*** | (2006.01) |
| ***A47L 17/08*** | (2006.01) |
| ***A47L 7/00*** | (2006.01) |

(52) U.S. Cl. ..... 15/228; 15/320

(58) Field of Classification Search ..... 15/228, 15/320

See application file for complete search history.

(56) References Cited

U.S. PATENT DOCUMENTS

| | | | | |
|---|---|---|---|---|
| 1,720,165 | A | 7/1929 | Bloom | |
| 2,053,282 | A | 9/1936 | Gewalt | |
| 2,730,748 | A * | 1/1956 | Smyth | 15/229.8 |
| 4,073,030 | A | 2/1978 | Albishausen | |
| 4,074,387 | A | 2/1978 | Arato et al. | |
| 4,327,459 | A | 5/1982 | Gilbert | |
| 4,584,736 | A | 4/1986 | Gremminger | |
| 4,852,210 | A * | 8/1989 | Krajicek | 15/228 |
| 4,905,712 | A | 3/1990 | Bowlin et al. | |
| 5,165,866 | A | 11/1992 | Kato | |
| 5,920,952 | A * | 7/1999 | Baldacci | 15/320 |
| 6,289,551 | B1 | 9/2001 | Basile | |
| 6,490,753 | B1 | 12/2002 | Chen | |

(Continued)

FOREIGN PATENT DOCUMENTS

CH 429 211 A 1/1967

(Continued)

OTHER PUBLICATIONS

Patent Abstracts of Japan, vol. 2002, No. 3, Apr. 3, 2002, Publication No. 2001327449 (Alpha Homes: KK), Nov. 21, 2001.

(Continued)

*Primary Examiner* — Bryan R Muller

(74) *Attorney, Agent, or Firm* — Wolf, Greenfield & Sacks, P.C.

(57) ABSTRACT

A steam pad for use with a steam mop is provided. The steam pad includes at least one layer of fabric having at least one fastener that corresponds to at least one fastener on the steam mop. In another embodiment, the steam pad comprises a first layer of fabric, a corresponding second layer of fabric, where the first and second layer are joined around the perimeter and where the second layer of fabric has at least one fastener that corresponds to at least one fastener on the steam mop.

17 Claims, 7 Drawing Sheets

U.S. PATENT DOCUMENTS

| | | | | |
|---|---|---|---|---|
| 6,571,421 | B1 | 6/2003 | Sham et al. | |
| 6,601,261 | B1 * | 8/2003 | Holt et al. | 15/228 |
| 7,380,307 | B2 * | 6/2008 | Tsai | 15/320 |
| 2002/0094285 | A1 | 7/2002 | Paolini et al. | |
| 2002/0106970 | A1 | 8/2002 | Falla | |
| 2002/0112744 | A1 | 8/2002 | Besseling | |
| 2003/0089383 | A1 | 5/2003 | Biggs | |
| 2004/0134016 | A1 | 7/2004 | Kisela | |
| 2006/0000049 | A1 * | 1/2006 | Rosenzweig | 15/322 |
| 2007/0130719 | A1 | 6/2007 | Zhou | |
| 2008/0066789 | A1 * | 3/2008 | Rosenzweig et al. | 134/106 |

FOREIGN PATENT DOCUMENTS

| | | | |
|---|---|---|---|
| CN | 1368032 | A | 9/2002 |
| CN | 2540155 | Y | 3/2003 |
| CN | 2568117 | Y | 8/2003 |
| DE | 24 31 102 | A1 | 1/1976 |
| DE | 91 10 171 | U1 | 3/1993 |
| DE | 298 22 052 | U1 | 2/1999 |
| DE | 299 10 658 | U1 | 9/1999 |
| DE | 29910658 | U1 * | 9/1999 |
| DE | 200 01 462 | U1 | 1/2001 |
| DE | 100 15 941 | A1 | 10/2001 |
| DE | 102 05 507 | A1 | 8/2003 |
| DE | 20 2006 001189 | U1 | 4/2006 |
| EP | 1 027 855 | A | 8/2000 |
| EP | 1 224 899 | A | 7/2002 |
| EP | 1 554 968 | A | 7/2005 |
| FR | 601 312 | A | 2/1926 |
| FR | 709 689 | A | 8/1931 |
| FR | 2 282 252 | A | 3/1976 |
| GB | 1 449 483 | | 8/1973 |
| GB | 2 294 196 | A | 4/1996 |
| GB | 2 416 526 | A | 2/2006 |
| JP | 2001327449 | A | 11/2001 |
| JP | 2004337454 | A | 12/2004 |
| WO | WO 98/23385 | A | 6/1998 |
| WO | WO 99/26522 | A | 6/1999 |
| WO | WO 02/43550 | A | 6/2002 |
| WO | WO 2007/065371 | A | 6/2007 |

OTHER PUBLICATIONS

Euro-Pro Operating LLC; Steam Shark II Owner's Manual Model EP908EF; Nov. 2003; St. Laurent, Quebec H4S 1A7, pp. 1-39.

Euro-Pro Operating LLC; Portable Shark Steam Cleaner Owner's Manual Model SC505; Jan. 2003; p. 7; Champlain, NY 12919, pp. 1-11.

* cited by examiner

FABRIC PAD FOR A STEAM MOP

CROSS-REFERENCE TO RELATED APPLICATIONS

This is a continuation-in-part application of U.S. application Ser. No. 11/769,521, filed Jun. 27, 2007.

BACKGROUND OF THE INVENTION

The invention relates generally to steam mops, and more particularly to a fabric steam pad for use with a steam mop.

Conventional mops have been widely used for cleaning floors. However, conventional mops have not been effective at cleaning dirt in small crevices and floor gaps. In addition, conventional mops require frequent rising since mops can only effectively clean a small surface area at a time.

Steaming devices used to apply steam to household objects are well known. The uses of the devices vary widely, and may include the application of steam to drapes or other fabrics to ease wrinkles, and the application of steam to objects to assist in cleaning the objects.

Typical steam devices have a reservoir for storing water that is connected to an electrical water pump with an on/off switch. The exit from the electric water pump is connected to a steam boiler with a heating element to heat the water. The heated water generates steam, which may be directed towards its intended destination through a nozzle which controls the application of the steam. Variation of the shape and size of the nozzle allows for preferred distribution of generated steam to an object to be cleaned. The nozzles may be disconnectable from the steam generator to allow different nozzles to be utilized, based on the object to be steamed. The nozzle may be either closely coupled to the steam generator, or located at a distance from the steam generator, requiring tubing or other steam transfer structures to be interconnected between the steam generator and the discharge nozzle. Typically, it is beneficial to provide suitable connectors between the steam generator and the nozzle to allow either the nozzle to be connected to the steam generator, or to allow the interpositioning of transfer tubes or hoses between the steam generator and the nozzle.

In general, the nozzles used with the steam cleaners do not have large surface areas and a cloth to absorb the liquid condensate of the steam. Often steam injected behind the cloth passes through the cloth at the points the bristles contact on the cloth. This tends to wet the cloth and reduce the cleaning effectiveness of the steam. In addition, the cloth covers must be carefully attached so as to not to cover the front or back of the brush attachment.

Notwithstanding the wide variety of steam generating appliances available, there exists the need to provide an easy to use steam mop and steam mop pad. That will effectively improve the effective steaming surface area of the steam cleaners. It is desirable to provide this device with the ability for a user to clean a larger surface area easily without worrying about wiping up the liquid condensate of the steam when cleaning flooring, furniture and other household items.

SUMMARY OF THE INVENTION

Generally speaking, in accordance with the invention, a fabric steam pad to be mounted on the steam pad frame of a steam mop to provide an improved cleaning surface. The fabric steam pad provides a substantially outer planar surface for cleaning and has on the opposed inner surface at least one fastener for removeably attaching it to the steam frame. The fastener may be a conventional hook-and-loop fastener, commonly known as "Velcro."

In one embodiment, the fabric steam pad is formed from two fabric layers that are joined at their edges. Fasteners on the inner surface of the pad for fastening to corresponding fasteners on the steam frame for easy installation and removal. The pad may be any geometric shape, such as rectangular, circular or triangular.

Accordingly, it is an object of the invention to provide a fabric steam pad that is easily mounted on and removed from a steam pad frame.

Yet a further object of the invention is to provide a steam pad frame attachment for a fabric pad that does not allow steam to escape as occurs at points of contact with brush bristles.

Still other objects and advantages of the invention will in part be obvious and will in part be apparent from the specification.

The invention accordingly comprises a product possessing the features, properties, and the relation of components which will be exemplified in the product hereinafter described, and the scope of the invention will be indicated in the claims.

BRIEF DESCRIPTION OF THE DRAWINGS

For a fuller understanding of the invention, reference is made to the following description taken in connection with the accompanying drawing(s), in which.

DETAILED DESCRIPTION OF THE INVENTION

Figure 1:
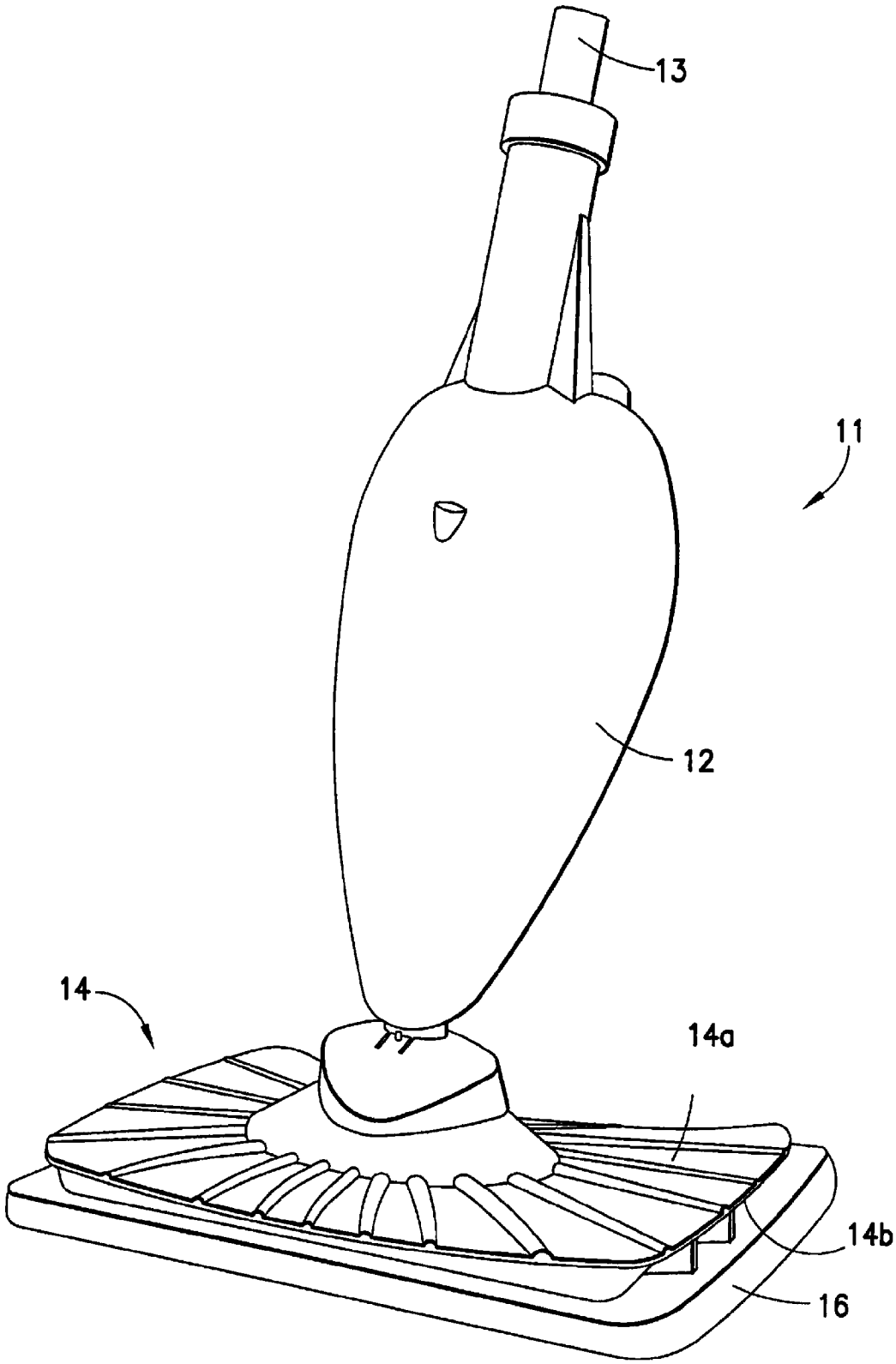
FIG. 1 is a perspective view of steam mop housing and steam frame including a fabric steam pad constructed and arranged in accordance with the invention.

FIG. 1 is a perspective view of a steam mop 11 having an elongated housing 12 with a connecting handle 13 at one end and a steam frame 14 at the opposite end. Steam frame 14 has an upper surface 14*a* and an opposed bottom cleaning surface 14*b*. A fabric steam pad 16 is removeably fastened to bottom cleaning surface 14*b*.

Figure 2:
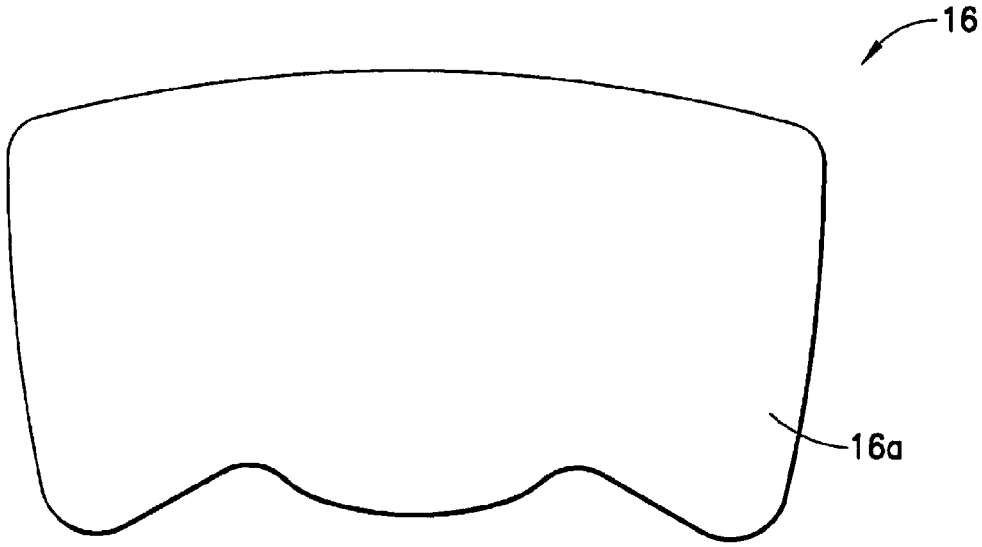
FIG. 2 is a plan view of the outside cleaning surface of the fabric steam pad in accordance with the invention.
Figure 3:
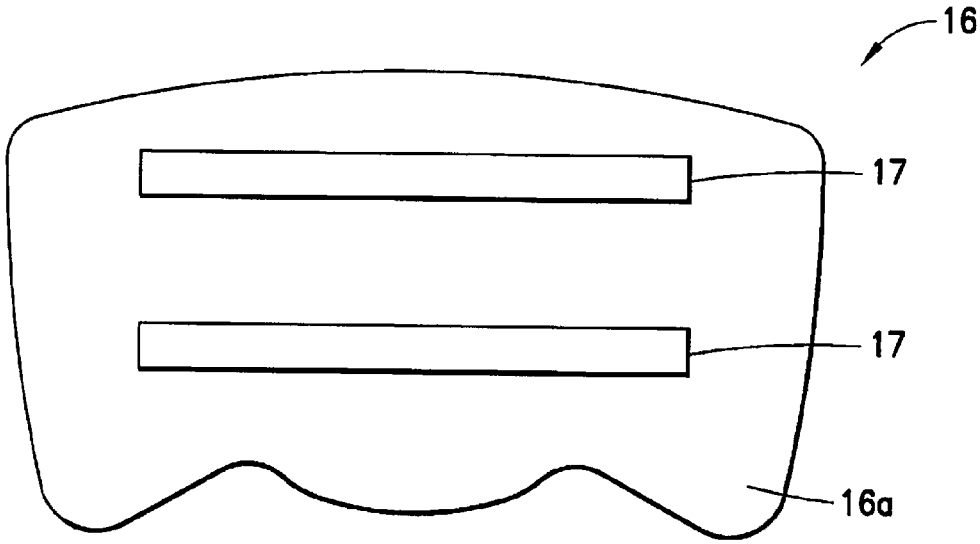
FIG. 3 is a plan view of the upper surface of the fabric steam pad of FIG. 2 showing hook-and-loop fastening bands on the upper surface.

Steam pad 16 has a bottom cleaning surface 16*a* shown in FIG. 2 and an upper fastening surface 16*b* shown in FIG. 3. Fastening surface 16*b* has a pair of hook and loop fastening bands 17 mounted thereon. Bands 17 attach to steam frame bottom surface 14*b* as described below in connection with FIG. 4.

Figure 6:
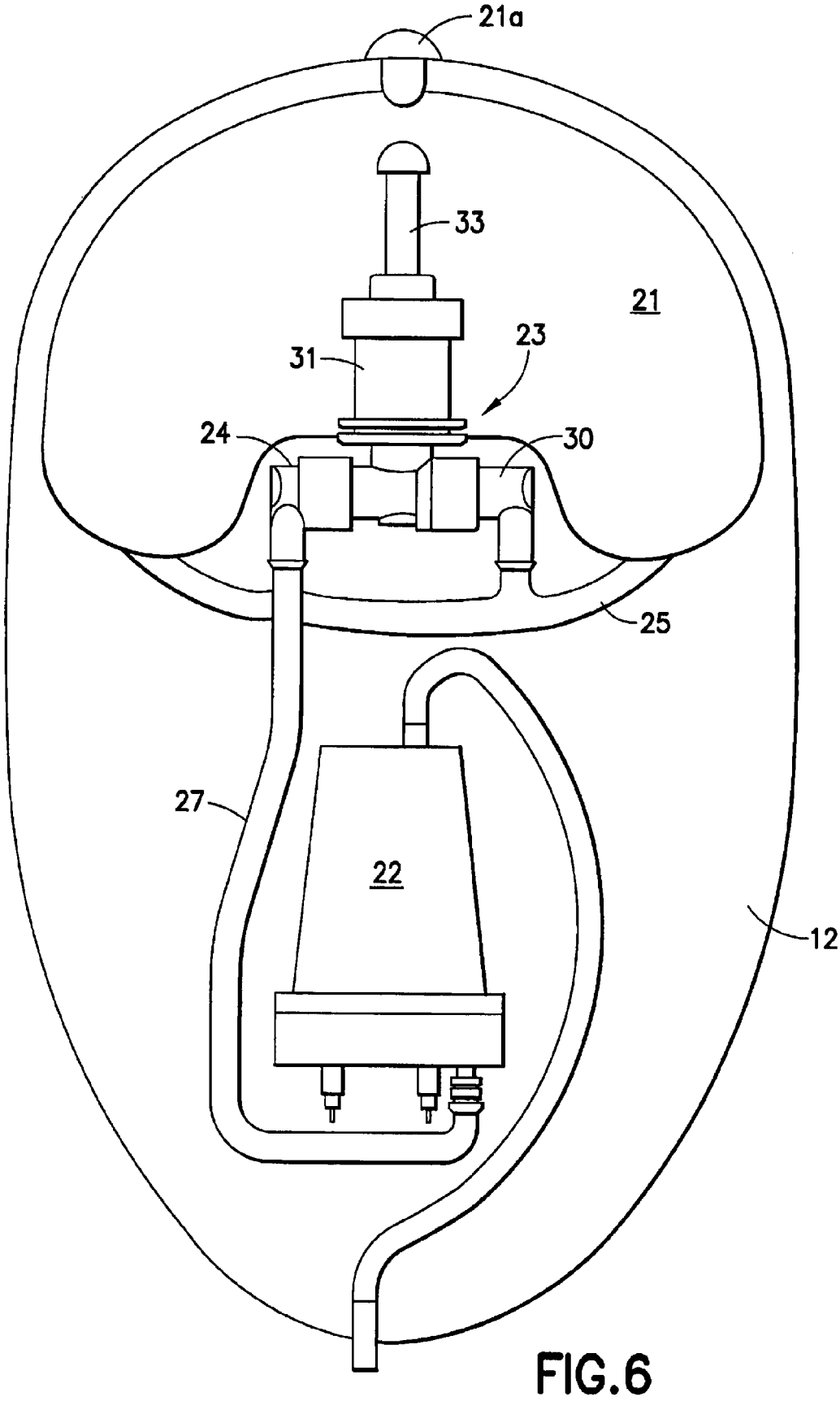
FIG. 6 is a front plan view of the steam mop housing and showing a reservoir, pump and boiler.

Mop housing 12 includes a water container or tank 21 as shown in FIG. 6 connected to a boiler 22 by a pump 23 having a one-way outlet valve 24. Any type of mechanical pump or some other means of transporting the water to the boiler may be used with steam mop 11. Preferably, pump 23 is a mechanical pump, such as a bellows pump or a piston pump, that is actuated by movement of mop 11 by a user pushing and pulling handle 13.

Figure 4:
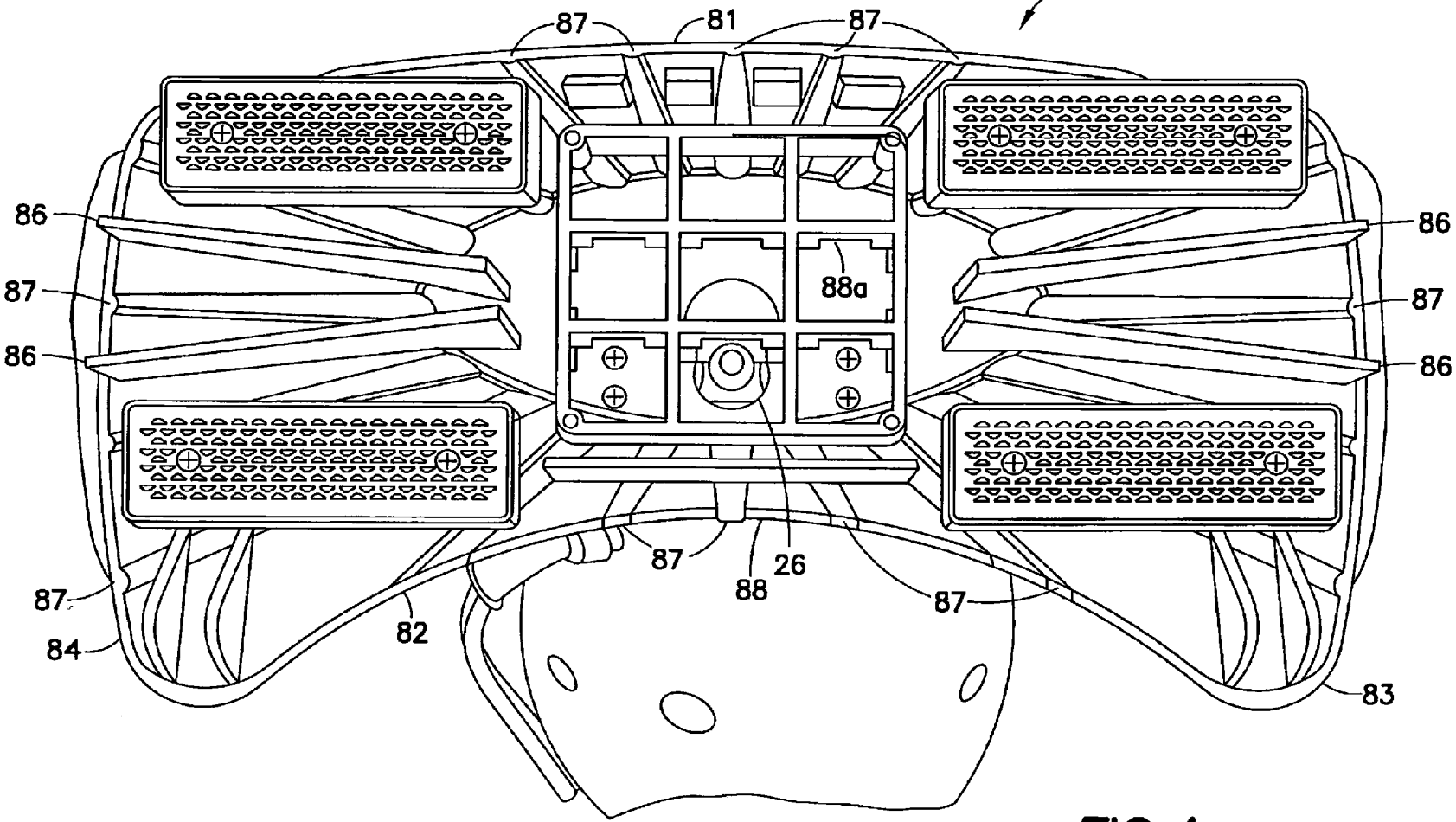
FIG. 4 is a plan view of the bottom cleaning surface of the steam frame of the mop in FIG. 1.

Steam pad frame 14 shown in FIG. 4 is substantially rectangular in shape and includes a central steam opening 26. Steam generated in steam boiler 22 dispenses steam into frame 14 through central steam opening 26 of frame 14. Steam frame bottom 14*b* includes four hook-and-loop fastening elements 18 for cooperating with fastening bands 17 on pad 14.

FIG. 4 is a plan view of the bottom cleaning surface 14*b* of the steam frame 14 of the mops in FIGS. 1 and 3. Here, bottom of steam frame 14 includes hook-and-loop fastening elements 18 to be attached to fastening bands 17 on upper surface 14*a* of steam pad frame 14. Steam frame 14 includes a front wall 81, a rear wall 82, a right side wall 83 and a left side wall 84. Also, steam frame 14 includes a plurality of vanes 86 to help disperse the steam uniformly throughout frame 14 and a plurality of grooves 87 to help release extra steam from steam pad 16 when steam pad 16 is attached to steam frame 14 as shown in FIG. 1. A plurality of baffles 88*a* in a square grid formation may be disposed over steam opening 26.

Figure 9:
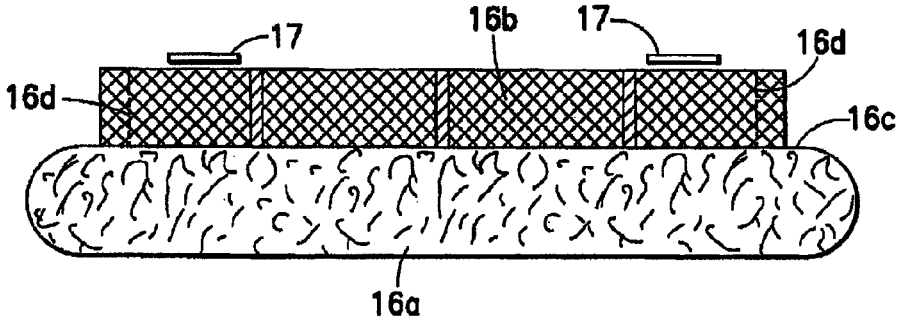
FIG. 9 is a sectional view of the fabric pad of FIGS. 2 and 3.

In the illustrated embodiment, steam pad 16 is a cloth or towel. It may be formed of any suitable fabric such as cotton or a synthetic fabric, such as polyester or polyolefin fiber. Generally, steam pad 16 is formed from two layers of fabric stitch about the perimeter. In a preferred embodiment of the invention, steam pad bottom surface 16*a* is a velour microfiber material and a mesh fabric 16*b* is joined to upper surface 16*c* of the velour microfiber material. A cross section is shown in FIG. 9. Upper mesh fabric surface 16*b* is stitched to pad 16 by a seam 16*d*. Preferably, the fabric of pad 16 is a microfiber. Most preferably, the microfiber is a synthetic polyester microfiber.

Figure 7:
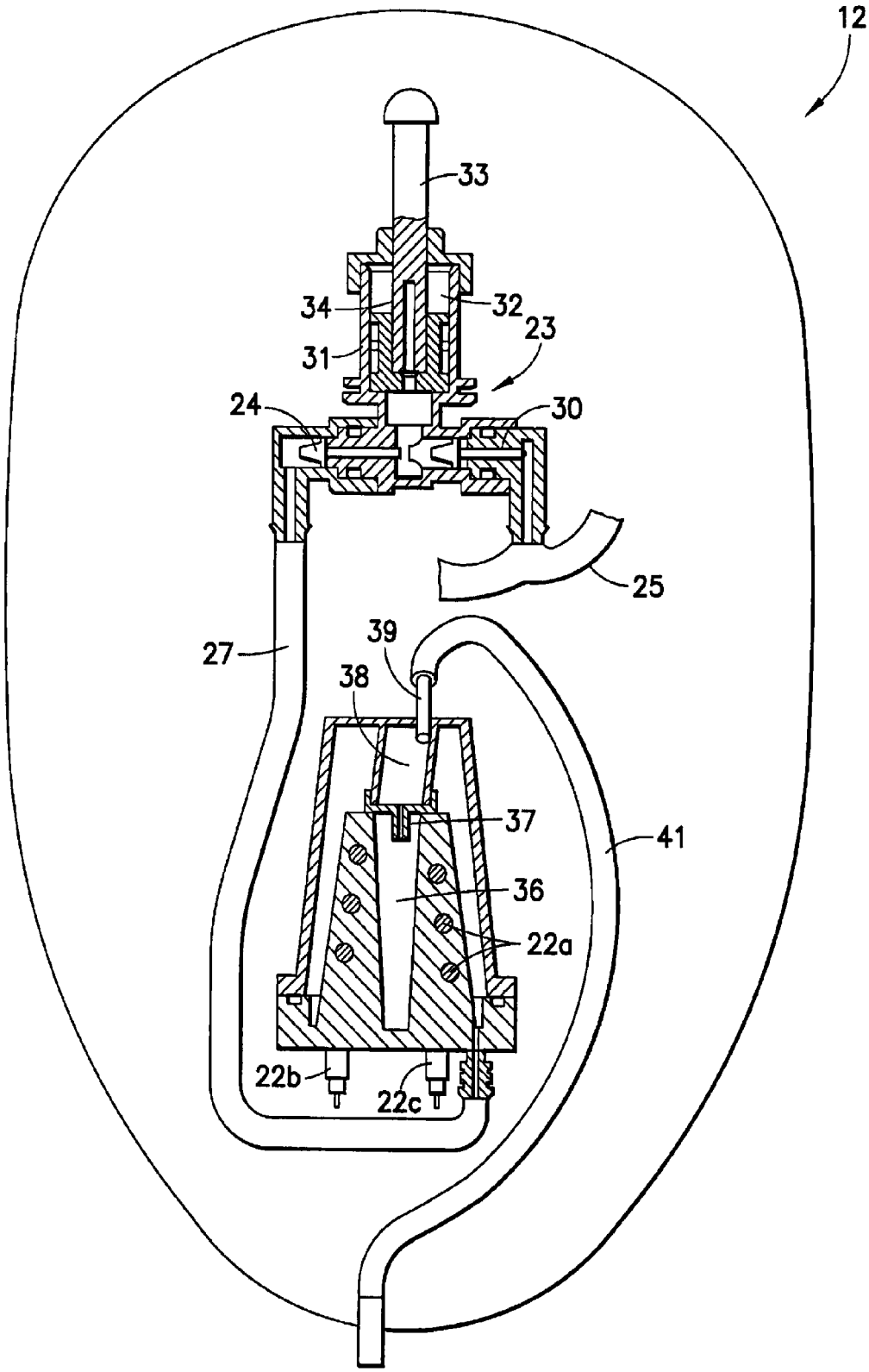
FIG. 7 is a section view of the principal elements of FIG. 6.
Figure 8:
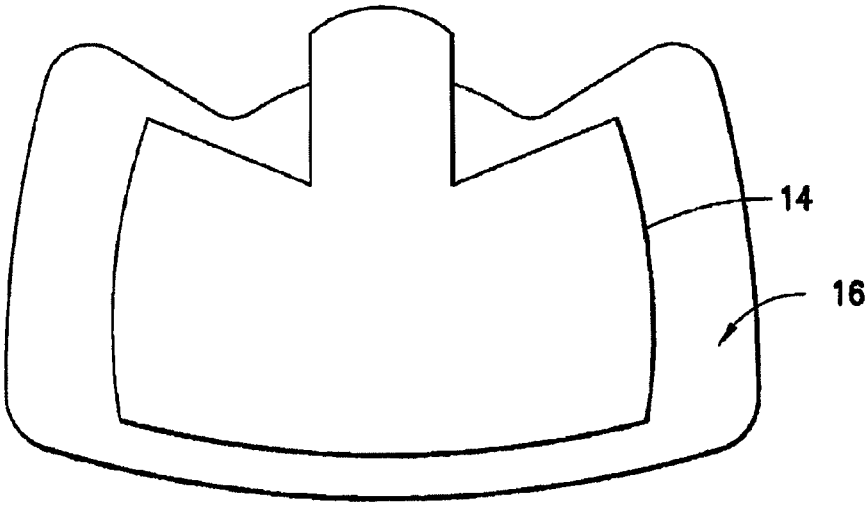
FIG. 8 is a top plan view of the mop of FIG. 1 with a fabric steam pad mounted on the steam frame.

FIGS. 6 and 7 are a front plan and section views, respectively, of the elements in housing 12 of steam mop 11. This includes water container or tank 21, one-way pump 23 and boiler 22. A pump water supply hose 25 is connected to a one-way inlet valve 30. A pump water outlet 24 is connected to boiler 22 through a boiler water supply hose 27. Water container 21 includes an opening 21*a* that may be easily opened and closed for the user to fill mop 11 with water.

Water pump 23 includes a pump body 31 having a pump cavity 32. A piston 33 connected to a push rod 34 is positioned in cavity 32. As mop handle 13 is pulled by a user, push rod 34 and piston 33 create a negative pressure in cavity 32. This draws water from tank 21 into pump water supply hose 25 and into one-way inlet valve 30. As handle 13 is pushed during use, water in cavity 32 is expelled through one-way outlet valve 24. This pumped water then passes to boiler 22. Water in boiler 22 is heated by a heating element 22*a* in a boiler cavity 36 and steam generated is fed through a steam valve 37 into a steam chamber 38. Heating element 22*a* is connected to electrical connectors 22*b* and 22*c*. Steam is then expelled through a steam outlet 39 to a steam hose 41 and to frame nozzle 16.

One-way inlet valve 30 and one-way outlet valve 24 are formed of a flexible elastomeric material, such a rubber. The valves are conical in shape so that when handle 13 is pulled, water is drawn through inlet valve 30 while outlet valve 24 remains closed. Similarly, when handle 13 is pushed, water is forced out through outlet valve 24 and inlet valve 30 remains closed and water is fed into boiler 22.

Figure 5:
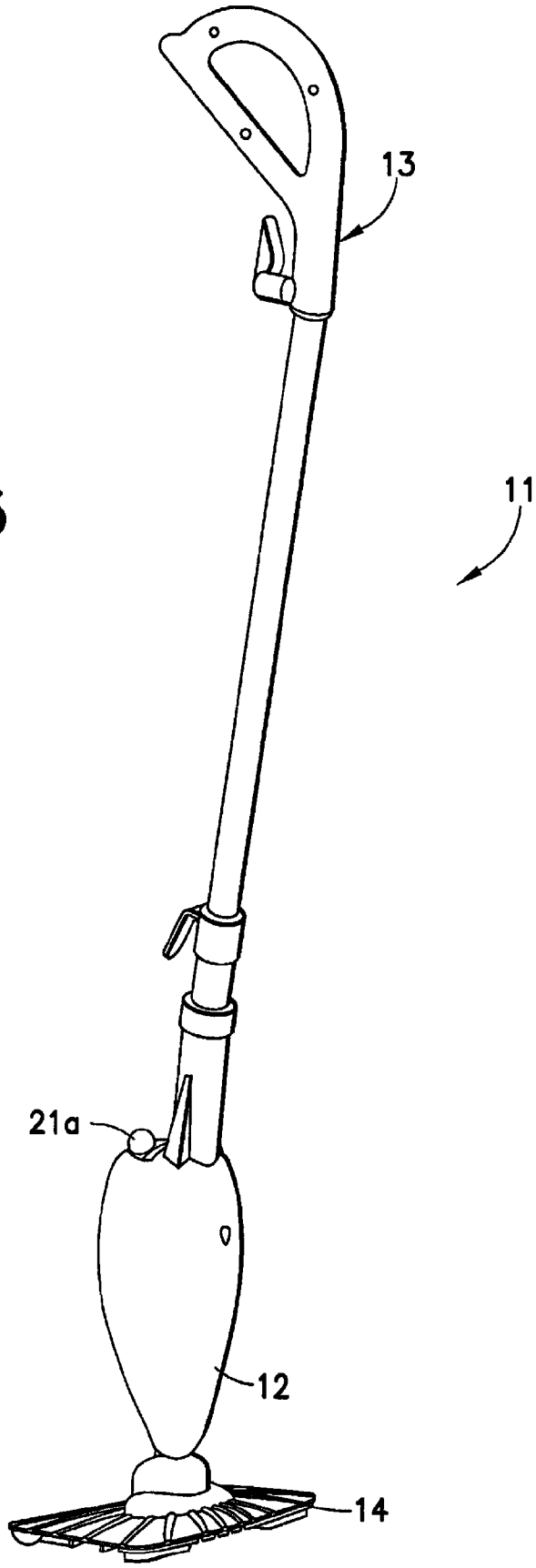
FIG. 5 is a perspective view of a push-pull floor steam mop with a steam frame as shown in FIG. 1.

FIG. 5 is a perspective view of the mop of FIG. 1 as a floor mop with fabric steam pad 16 mounted on steam frame 14. Fabric steam pad 16 is attached to steam pad frame 14 by fasteners (not shown). Also, in this example, fabric steam pad is larger than steam pad frame to provide increased steam cleaning surface area.

In the preferred embodiment, fabric steam pad 16 is made of an upper layer 16*b* and a bottom cleaning layer 16*a* of fabric that are joined by stitching 16*d* around the perimeter. Upper layer 16*b* has at least one fastener 17 that corresponds to at least one fastener for mounting on steam mop frame 14. This fabric steam pad is substantially rectangular; however, it may be any convenient geometric shape, such as a triangle or circle. Bottom cleaning layer 16*a* of fabric may be formed of a microfiber, such as a polyester microfiber. Upper layer 16*b* of fabric may be form of a mesh fabric and fasteners 17 are a Velcro-type fastener.

Steam floor mop 11 provides many advantages for ease of use because it eliminates the need for an electric water pump and an on/off switch to activate the electric water pump. Here, the user has more control over the amount of water needed to be discharged into the boiler and consequently, how much steam is needed by moving the mop forward and backwards. In addition, steam mop is designed as a low pressure or non-pressurized system so it is safer for the user to use. Further, since the amount of water routed to the boiler is controlled, the boiler can create steam in a short amount of time.

It will thus be seen that the objects set forth above, among those made apparent from the preceding description, are efficiently attained and, since certain changes may be made in the above product without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

The present invention may be embodied in other specific forms without departing from the spirit or essential attributes of the invention. Accordingly, reference should be made to the appended claims, rather than the foregoing specification, as indicating the scope of the invention. A steam pad frame attachment with a fabric pad cover in accordance with the invention provides a vast improvement over placing a towel onto a bristle attachment for a steam cleaned. It avoids puncture of the cloth by the bristles. Moreover, the fabric cover is easily installed and replaced.

What is claimed is:

1. A method of assembling a steam cleaner including:

providing a steam frame including a top, bottom including a bottom surface, a steam opening arranged to provide steam to under the bottom of the steam frame, the steam frame including at least one fastening element arranged to secure a steam pad to the bottom of the steam frame;

providing a steam pad including an upper surface having at least one fastener portion that is arranged to be complementary to the at least one fastening element to secure the steam pad to the bottom of the steam frame, the steam pad further including a bottom cleaning layer; and securing the steam pad to the steam frame by attaching each of the at least one fastening elements to its complementary fastener portion such that the steam pad and the steam frame co-act to form one or more steam flow paths between the steam frame and the steam pad that extend to one or more outlets at periphery of the steam frame that are arranged to release excess steam from the steam cleaner, the one or more outlets being unobstructed by the pad or any portion of the steam frame, and the steam frame including a plurality of vanes protruding from the bottom surface of the steam frame that space the pad from the bottom surface of the steam frame and one or more grooves in the bottom surface of the steam frame to form the one or more steam flow paths.

2. A method as in claim 1, wherein the bottom cleaning layer comprises a microfiber.

3. A method as in claim 1, wherein the at least one fastening element comprises a hook-and-loop fastening element.

4. A method as in claim 1 wherein the vanes extend in a direction away from the steam outlet toward walls of the steam frame.

5. A method as in claim 1, wherein the fastener portion of the upper surface of the pad comprises a band of fastener material.

6. A method as in claim 1, wherein the fastener portion of the upper surface of the pad comprises a hook-and-loop fastener.

7. A method as in claim 1, wherein the steam pad is larger than the steam frame.

8. A method as in claim 1, further comprising a water container, a boiler, and a mechanical pump configured to transport water from the water container to the boiler.

9. A steam cleaner comprising:

a steam frame including a top, a bottom including a bottom surface and a steam opening arranged to provide steam to under the bottom of the steam frame, the steam frame including at least one fastening element arranged to secure a steam pad to the bottom of the steam frame; and a steam pad including an upper surface having at least one fastener portion that is arranged to be complementary to the at least one fastening element to secure the steam pad to the bottom of the steam frame, the steam pad further including a bottom cleaning layer;

wherein with the steam pad secured to the steam frame via attachment of each of the at least one fastening elements to its complementary fastener portion, the steam pad and the steam frame co-act to form one or more steam flow paths between the steam frame and the steam pad that extend to one or more outlets at a periphery of the steam frame that are arranged to release excess steam from the steam cleaner, the one or more outlets being unobstructed by the pad or any portion of the steam frame, and the steam frame including a plurality of vanes protruding from the bottom surface of the steam frame hat space the pad from the bottom surface of the steam frame and one or more grooves in the bottom surface of the steam frame to form the one or more steam flow paths.

10. A steam cleaner as in claim 9, wherein the bottom cleaning layer comprises a microfiber.

11. A steam cleaner as in claim 9, wherein the at least one fastening element comprises a hook-and-loop fastening element.

12. A steam cleaner as in claim 9, wherein the vanes extend in a direction away from the steam outlet toward ails of the steam frame.

13. A steam cleaner as in claim 9, wherein the fastener portion of the upper surface of the pad comprises a band of fastener material.

14. A steam cleaner as in claim 9, wherein the fastener portion of the upper surface of the pad comprises a hook-and-loop fastener.

15. A steam cleaner as in claim 9, wherein the steam pad is larger than the steam frame.

16. A steam cleaner as in claim 9, further comprising a water container, a boiler, and a mechanical pump configured to transport water from the water container to the boiler.

17. A steam cleaner comprising:

a steam frame including a top, a bottom including a bottom surface and a steam opening arranged to provide steam to under the bottom of the steam frame, the steam frame including at least one fastening element arranged to secure a steam pad to the bottom of the steam frame; and a steam pad including an upper surface having at least one fastener portion that is arranged to be complementary to the at least one fastening element to secure the steam pad to the bottom of the steam frame, the steam pad further including a bottom cleaning layer;

wherein with the steam pad secured to the steam frame via attachment of each of the at least one fastening elements to its complementary fastener portion, the steam pad and the steam frame co-act to form one or more steam flow paths between the steam frame and the steam pad that extend to one or more outlets at a periphery of the steam frame that are arranged to release excess steam from the steam cleaner, the one or more outlets being unobstructed by the pad or any portion of the steam frame, and the steam frame including a plurality of protrusions extending from the bottom surface of the steam frame that space the pad from the bottom surface of the steam frame and one or more grooves formed in the bottom surface of the steam frame and extending to an outer edge of the steam frame to form the one or more steam flow paths.

* * * * *

UNITED STATES PATENT AND TRADEMARK OFFICE

CERTIFICATE OF CORRECTION

PATENT NO. : 8,261,402 B2
APPLICATION NO. : 12/044301
DATED : September 11, 2012
INVENTOR(S) : Maximilian Rosenzweig et al.

It is certified that error appears in the above-identified patent and that said Letters Patent is hereby corrected as shown below:

At column 4, claim 1, line 50, please change “bottom” to --a bottom--.

At column 4, claim 1, line 65, please change “periphery” to --a periphery--.

At column 6, claim 12, line 7, please change “ails” to --walls--.

Signed and Sealed this
Twenty-second Day of January, 2013

David J. Kappos

David J. Kappos
*Director of the United States Patent and Trademark Office*